United States Patent [19]

Stephens

[11] 3,930,576

[45] Jan. 6, 1976

[54] COMBINED PACKAGING AND DISPLAY BOX

[76] Inventor: Paul B. Stephens, 1234 S. Wabash Ave., Chicago, Ill. 60605

[22] Filed: Sept. 5, 1974

[21] Appl. No.: 503,477

Related U.S. Application Data

[63] Continuation of Ser. No. 304,723, Nov. 8, 1972, abandoned.

[52] U.S. Cl. ..... 206/45.11; 206/45.14; 206/75; 206/806

[51] Int. Cl.[2] ..... B65D 25/02

[58] Field of Search..... 206/45.11, 45.13, 45.14, 206/45.19, 75, 76, 806

[56] References Cited

UNITED STATES PATENTS

| | | | |
|---|---|---|---|
| 490,365 | 1/1893 | Russell | 206/806 X |
| 1,094,605 | 4/1914 | Shipman | 206/45.11 UX |
| 2,751,070 | 6/1956 | Morse | 206/45.14 |
| 2,788,123 | 4/1957 | Levis et al. | 206/45.19 X |
| 2,950,003 | 8/1960 | Simmons et al. | 206/75 |
| 2,962,156 | 11/1960 | Adams | 206/45.14 |
| 3,370,702 | 2/1968 | Rosen | 206/76 |

*Primary Examiner*—Leonard Summer
*Attorney, Agent, or Firm*—John Harrow Leonard

[57] ABSTRACT

A jewelry display and packaging box has a bottom and a cover connected together by a hinge for swinging to open and closed positions. The bottom has an upwardly facing display panel on which a piece of jewelry is detachably supported in a display position. The cover has a large concavity therein which faces toward the box bottom in the closed position of the cover. A jewelry support is mounted on the box and has one or more jewelry supporting portions which are disposed in spaced relation to the walls of the concavity, and above the level of the panel. The portions are arranged to suspend one or more articles of jewelry in spaced relation above, and in overhanging relation to, that portion of the display panel which is adjacent the hinge, and so that the articles extend partway into the concavity and hang in spaced relation to the concavity walls and can dangle and swing freely, whereby rays of light reflected and refracted from each dangling article continuously shift directions. Closure of the cover moves the support and each article supported thereby to a position in which the articles are fully enclosed in the box in spaced relation to the article of jewelry on the panel.

8 Claims, 6 Drawing Figures

COMBINED PACKAGING AND DISPLAY BOX

This is a continuation of application Ser. No. 304,723 filed Nov. 8, 1972, now abandoned.

BACKGROUND OF THE INVENTION

1. Field of the Invention

Jewelry boxes.

2. Description of Prior Art

Heretofore in displaying articles of jewelry, particularly in sets such as a finger ring and earrings to match, or cuff-links and a tie stud, the conventional practice has been to detachably mount the articles in fixed position on an upwardly exposed felt or like decorative display panel, in the bottom of a box so that the articles, when the box is open, are disposed in a position in which the decorative portions are fully displayed. The box, when closed, serves as a package for the articles. In other instances, the parts of a set are mounted on a display standard from which they are removed and packaged in a conventional jewelry box when sold to the customer.

In accordance with the present invention, a combined display and packaging box is provided in which provision is made for displaying one of the articles of the jewelry on the display panel in the bottom of the box in the customary manner, and for suspending one or more matching articles near the upper edge of the open cover of the box in a manner such that they can dangle and swing freely in overhanging relation to the panel when the box is open. When two matching articles are thus suspended and the cover closed, they can accommodate therebetween the article mounted on the panel.

SUMMARY OF THE INVENTION

The combined display and packaging box, when placed in open position on a counter or shelf, displays the contained articles of jewelry in a mobile relation to each other such that rays of light falling thereon are reflected and refracted in continuously shifting directions during the mobility and thereby attract attention to, and enhance the appearance of, the articles. Further, the articles are well packaged and prevented from contact with each other by closing the box.

Various other specific objects and advantages will become apparent from the following description, wherein reference is made to the drawing.

BRIEF DESCRIPTION OF THE DRAWING

Referring to the drawings, the combined display and packaging box of the present invention comprises a box bottom 1 and a cover 2 which is connected along one of its edges to an upper edge of the bottom 1 by a hinge 3 for swinging to open and closed positions relative to the bottom 1. As illustrated in FIGS. 1 through 4, when the box bottom is resting on a horizontal surface, the cover is in an upright open position. The bottom 1 has secured therein a display member, indicated generally at 4 and comprising an upwardly open boxlike liner 5 in which is mounted a display panel 6 having its upper or display face covered with velvet or like decorative material, and having the usual slot 7 by which a ring may be detachably connected to the panel with its decorative setting superposed above the display face. When other types of jewelry are to be displayed on the panel 6, the velvet covering acts as a holding means in which the piece of jewelry can be pinned or otherwise fastened.

The cover of the box is provided with a liner 9, similar to the liner 5, being in the form of a downwardly open box which preferably has a peripheral side wall 9*a* which can receive the upper margin of the peripheral side wall of the liner 5 telescopically. Thus the cover is provided with an enlarged concavity which opens in the direction facing the panel 6 when the box bottom and cover are in closed position and the box bottom is resting horizontally on a counter.

Figure 2:
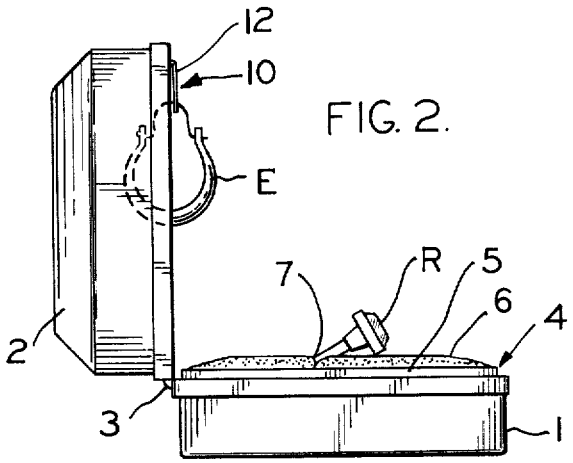
FIG. 2 is a left side elevation of the box illustrated in FIG. 1.
Figure 1:
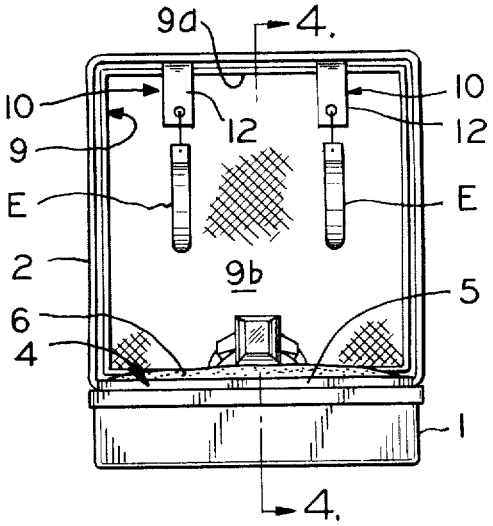
FIG. 1 is a front elevation of the display and packaging box embodying the principles of the present invention, the cover being shown in the open position with the box resting on a horizontal surface and with articles of jewelry displayed therein.
Figure 3:
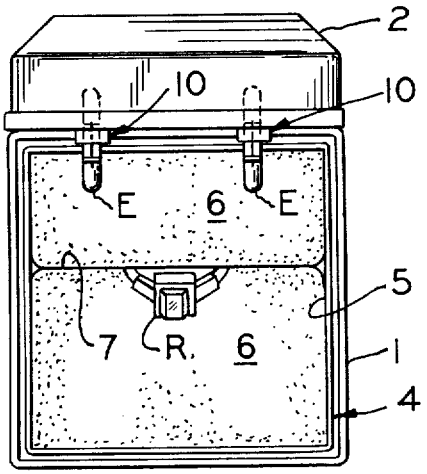
FIG. 3 is a top plan view of the box illustrated in FIG. 1.
Figure 4:
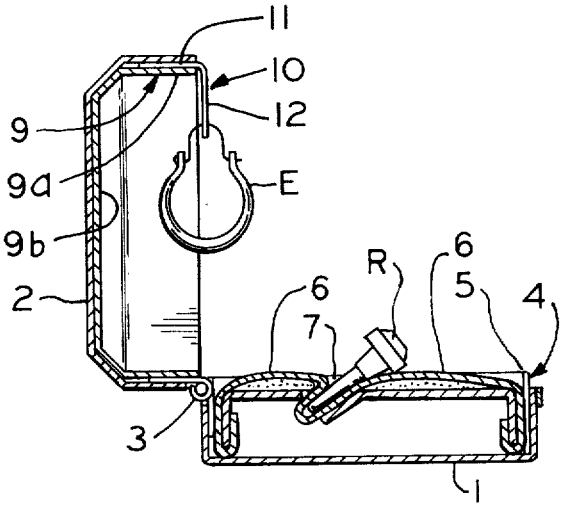
FIG. 4 is an enlarged fragmentary cross sectional view of the box, taken on line 4—4 in FIG. 1, showing the preferred mechanical connections among various parts.
Figure 5:
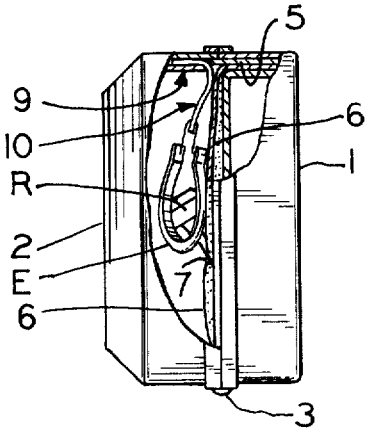
FIG. 5 is a left side elevation of the box illustrated in FIG. 1 with the cover in closed position, a portion of the cover being broken away to show the relation of the displayed jewelry elements therein to each other.
Figure 6:
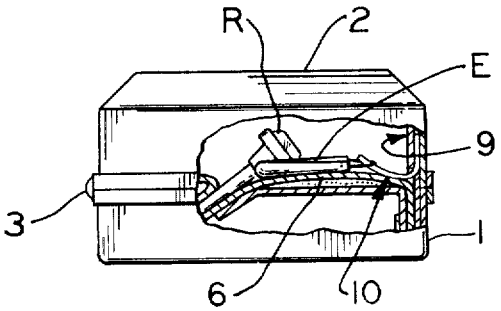
FIG. 6 is a left side elevation of the box with the cover closed, part of the cover being broken away showing the self-adjusting position of the articles of jewelry when the box is closed and in a position to rest on a horizontal surface.

The box such as above described is one commonly used for displaying a ring or a single piece of jewelry and of which the cover is upright when in one open position with the bottom horizontal, as illustrated in FIGS. 1-4. However, the present box is for displaying and packaging not only a ring or single article of jewelry, but articles of a matched set of jewelry.

For purposes of illustration, the invention is shown as used for displaying a finger ring R and matching earrings E. For this purpose, the ring R is supported in the conventional manner on the panel 6, as above described. A suspending support is provided which supports the pair of earrings E in a position spaced above a portion of the panel 6 which is near the hinge axis and in such spaced relation to the back wall and peripheral wall of the cover that the earrings E hang partly within and partly without the concavity in the cover 2, in spaced relation to the back wall of the liner of the cover. The earrings E are suspended in said spaced relation to the back wall and peripheral wall of the liner 9 so that they can dangle and swing freely both forwardly and rearwardly of the open cover 2 and laterally thereof. They are supported preferably so that they are disposed laterally of the cover 2 so as to be in symmetrical balance or relation at opposite sides of the displayed portion of the ring R.

Since the box is to be used both as a display box and a package, it is desirable that the support for the earrings be such that it folds or lies within the peripheral limits of the box bottom 1 and cover 2 in the closed position of the cover, and that it be in position to suspend the earrings as above described in the open position of the cover.

For this purpose, it is necessary that the support be carried either by the box bottom 1, the box cover 2, or the hinge 3. For purposes of illustration it is shown in its preferred form wherein it is mounted directly on the cover. A relatively inexpensive and attractive support is shown and is indicated at 10. In this form, the support 10 comprises a planar base 11 and tabs 12 lying in a plane extending at substantially right angles to the plane of the base. The base 11 is inserted between the peripheral wall 9*a* of the cover liner 9 and the peripheral wall of the cover at the side of the cover opposite from the axis of the hinge 3 so that it will be at the top edge of the cover when the cover is in the open position. The tabs 12, in the open position of the cover 2, depend from the upper edge of the cover 2 a substantial, but usually short, distance, so that the earrings can be fastened, one to each tab, at a location on the tabs in spaced relation below the upper wall 9*a* of the liner 9. For this purpose, an aperture 13 is provided in each tab, the aperture being sufficiently large so that the gripping parts of the associated earring can come together in contact therethrough for holding the earrings thereon. The aperture is sufficiently below the top portion of the wall 9*a* and sufficiently far above the panel 6 so that the earring will clear both by a substantial distance.

The depth of the concavity provided by the inner liner 9, from its open face to its back wall, indicated at 9*b*, is sufficient so that an earring connected to a tab 12, regardless of its rotated position about a vertical axis, can extend partway into the concavity of the cover and partway outwardly, in a direction away from the back wall of the concavity, beyond the open face of the cover 2. The spaced relation of each tab 12 is such that the earring suspended therefrom is free to swing toward and away from the back wall 9*b* a substantial distance when the cover is in the upright position shown in FIG. 2.

Of course, if the cover is not upright, but slightly overhangs the bottom 1, the earring can still remain suspended in upright position and overhang the panel 6 nearer to its midportion in a direction transversely of the hinge axis.

The tabs 12 are also spaced transversely of the cover so that the earrings E do not touch the lateral portions of the peripheral wall 9*a* of the liner 9.

In the case two earrings or two companion articles are to be displayed, and two such tabs 12 are provided, they may be on separate base portions 11 or on a common base as desired.

In the former case, since the base portions are frictionally held, or cemented, in fixed position, and since the cover and liner are rigid, the two base portions 11 along with the cover and liner provide in effect a common base for the tabs.

The tabs 12 are spaced apart laterally of the box so that the earrings are disposed at opposite sides of the lateral midportion of the cover and are in symmetrical relation to the ring R which is exposed at the lateral midportion of the panel 6.

The support 10 may be secured in position by inserting the base 11 between the wall 9*a* of the liner 9 and peripheral wall of the cover adjacent thereto, cementing the base in place, if desired, though generally frictional engagement is enough to hold the support 10 in position, and has the advantage of lateral adjustment to accommodate the support to the particular articles of jewelry to be displayed. The support 10 is movable to a position between the box bottom 1 and cover 2 in the closed position thereof by movement of the box and cover themselves into a relative closed position.

Preferably, the tabs 12 are made limp or readily flexible, especially in a direction toward and away from the back wall of the liner 9. For example, they may be soft fabric, or paper, or thin soft foam plastic. Their flexibility is such that, in any event, they assume a depending vertical position from the base 11 under the weight of the supported earring or other jewelry article, usually independently of the degree to which the cover is open. They can themselves be flexed forwardly and rearwardly of the open cover 2 by the weight of the article of jewelry itself.

Thus the earrings are supported in spaced relation to the peripheral and back wall of the concavity in the cover and are free to dangle and swing freely without interference by any portion of the cover. As a result, when the box is moved and set on the counter to show a customer, the earrings are thereby set in motion, swinging freely. As a result, refracted and reflected light rays from the jewelry provide a pleasing and ever changing scintillating appearance. If the box is left exposed in open condition in rooms where drafts occur, the earrings are caused to move continuously by the air drafts sufficiently so that they are in a continuous state of mobility dispensing light rays in unlimited patterns. The ever changing direction of the rays catch the eye of the passerby.

The support described is such that upon closure of the cover, after tilting it and the box bottom rearwardly, the earrings are moved back into the concavity of the cover on opposite sides of the ring displayed on the display panel 6, so that all of the articles nest within the cover without interferring with each other and are lightly held from contacting each other.

The connected tops of the earrings are below the rim of the box cover, and normally at or forwardly from the plane of the open face of the concavity. The holes are low enough, or the tabs are flexible enough, so that the earrings can hang pendent naturally under their own weight, and, in the case of flexible tabs, the tabs will assume their vertical positions under the weight of the earrings. Holes are not needed with flexible foam tabs.

As mentioned, in some instances, it is desirable to make the support extremely flexible, and for this purpose the two tabs may be of soft foam rubber or plastic. Such tabs have an advantage for mounting pieces of jewelry which might otherwise not dangle freely. For example, suppose that the jewelry to be displayed is a ring and matching cuff-links or the like which latter are rigid. In the normal condition of mounting, they would not dangle and swing about. Such soft and easily flexible tabs, however, can support any piece of jewelry to swing readily not only forwardly and rearwardly of the open cover, but also laterally thereof.

Having thus described my invention, I claim:

1. A jewelry display and packaging box comprising:

a bottom member adapted to rest in a horizontal position on a horizontal supporting surface, a display panel carried by said bottom member and having a face positioned to be exposed upwardly when said bottom member is in a horizontal position;

said bottom member having a front edge and a rear edge;

a cover member for the bottom member and having a top wall and peripheral wall depending from the top wall and defining therewith an open face unobstructed concavity which, in the closed position of the cover member, is open toward said face of the panel;

said peripheral wall including a front wall, and a rear wall positioned to lie at the front and rear edges, respectively, of said bottom member in the closed position of the cover member and side walls extending from the front wall to the rear wall;

said front, rear, and side walls having free edges, respectively, which, in said closed position of the cover member, engage said bottom member;

a hinge member connecting the cover member to the bottom member at the rear of the members so that the cover member can be swung about the hinge axis in a direction upwardly and rearwardly relative to the bottom member, in said horizontal position of the bottom member, to an open position in which the cover member is generally upright and the open face of the concavity thereof is exposed forwardly of the bottom member;

characterized in that:

an article support is carried by the cover and has a jewelry holding portion to which articles of jewelry can be detachably connected, and which portion, in said upright open position of the cover member, with the bottom member horizontal, swingably depends from a location which is at least close to said free edge of the front wall, downwardly toward the face of the panel, is spaced forwardly from said top wall, and is spaced laterally from said side peripheral walls of the cover member and of which portion the lower end is spaced upwardly away from said face of the panel, and is substantially directly beneath the free edge of said front peripheral wall in said upright position of the cover member, so that an article of jewelry can be connected to the holding portion and suspended therefrom so as to be swingable both toward and away from said top wall in spaced relation to said top wall and to said panel face in said upright open position of the cover member; and said support is arranged to be confined in the concavity between said top wall and said face of the panel in the closed position of the cover member.

2. The structure according to claim 1 wherein said support is connected to the cover member at said free edge of said front wall of the cover member.

3. The structure according to claim 2 wherein said article support extends from its point of connection with the cover member a short distance, in a direction toward the face of the panel, and in its entirety is in spaced relation above said face of the panel and above said bottom member, when the cover is in said upright open position with said face of the panel of the bottom member facing upwardly.

4. The structure according to claim 1 wherein said holding portion is relatively limp, at least in a direction toward and away from said top wall.

5. The structure according to claim 1 wherein said cover member comprises a hollow outer concavo-convex element and inner hollow concavo-convex element, each element having a top wall and a peripheral wall, and said inner element fitting into the outer element with the peripheral walls of the elements at a location opposite from the hinge axis in snug nesting relation; and said support has a connecting part disposed between said nesting portions of said peripheral walls at said location.

6. The structure according to claim 1 wherein the jewelry engaging and holding portion includes two holding fingers, each of which is a relatively limp strip of material of a width several times its thickness, said strips are symmetrically arranged in laterally spaced edgewise relation from each other in a direction parallel to said hinge axis, and disposed at opposite sides of the lateral midportion of said cover member, so that each holding portion is readily flexible toward and away from the top wall of the cover independently of the other.

7. The structure according to claim 6 wherein means are provided on the display panel for holding an article of jewelry on the bottom member with a decorative portion of the article exposed in superposed relation to said face of the display panel and, transversely of the bottom member, between the holding portions.

8. The structure according to claim 1 wherein the holding portion has a passage therethrough extending in a direction forwardly and rearwardly, of the box and adapted to receive a connecting part of a piece of jewelry to be supported by the holding portion.

* * * * *